US008816756B1

(12) United States Patent
Eberlein

(10) Patent No.: US 8,816,756 B1
(45) Date of Patent: Aug. 26, 2014

(54) BANDGAP REFERENCE CIRCUIT

(71) Applicant: Intel Mobile Communications GmbH, Neubiberg (DE)

(72) Inventor: Matthias Eberlein, Holzkirchen (DE)

(73) Assignee: Intel Mobile Communications GmbH, Neubiberg (DE)

( * ) Notice: Subject to any disclaimer, the term of this patent is extended or adjusted under 35 U.S.C. 154(b) by 0 days.

(21) Appl. No.: 13/799,848

(22) Filed: Mar. 13, 2013

(51) Int. Cl.
*G05F 1/10* (2006.01)

(52) U.S. Cl.
USPC ..... 327/539

(58) Field of Classification Search
USPC ..... 323/313, 314; 327/512, 513, 539
See application file for complete search history.

(56) References Cited

U.S. PATENT DOCUMENTS

| | | | | |
|---|---|---|---|---|
| 5,132,556 | A | 7/1992 | Cheng | |
| 6,137,341 | A * | 10/2000 | Friedman et al. | 327/513 |
| 6,407,622 | B1 * | 6/2002 | Opris | 327/539 |
| 6,426,669 | B1 | 7/2002 | Friedman et al. | |
| 6,605,987 | B2 | 8/2003 | Eberlein | |
| 6,795,343 | B2 | 9/2004 | Marotta et al. | |
| 7,301,389 | B2 * | 11/2007 | Coady | 327/539 |
| 7,495,505 | B2 * | 2/2009 | Chang et al. | 327/539 |
| 7,948,298 | B2 * | 5/2011 | Kameyama et al. | 327/513 |
| 8,222,955 | B2 * | 7/2012 | Duval et al. | 327/539 |
| 8,278,995 | B1 * | 10/2012 | Vu et al. | 327/539 |

OTHER PUBLICATIONS

A. Paul Brokaw; "A Simple Three-Terminal IC Bandgap Reference"; IEEE Journal of Solid-State Circuits, vol. sc-9, No. 6, Dec. 1974, p. 388-393.

Christian Jesus B. Fayomi, et al.; "Sub 1 V CMOS Bandgap Reference Design Techniques: a Survey"; Analog Integr Circ Sig Process; 2010; p. 141-157.

Jun Hu; "Design of a High-Performance Brokaw Band-gap Reference"; International Conference on ASID; 2010; p. 126-129.

Annema, A.; "A 0.0025mm Bandgap Voltage Reference for 1.1V Supply in Standard 0/16um CMOS"; 2012 IEEE International Solid-State Circuits Conference; p. 364-366.

* cited by examiner

*Primary Examiner* — Jeffrey Zweizig
(74) *Attorney, Agent, or Firm* — Eschweiler & Associates, LLC

(57) ABSTRACT

A circuit for generating a temperature-stabilized reference voltage on a semiconductor chip includes a differential pair including a first and a second bipolar junction transistor. The circuit further includes a feedback circuit including an amplification stage and configured to control a current flowing through the first bipolar junction transistor and a current flowing through the second bipolar junction transistor. A first resistor is connected between an emitter of the first bipolar junction transistor and an emitter of the second bipolar junction transistor, thereby generating a PTAT voltage across the first resistor. Further, the circuit includes a current source forcing a partial current having a CTAT behavior through the first resistor.

21 Claims, 4 Drawing Sheets

BANDGAP REFERENCE CIRCUIT

TECHNICAL FIELD

This disclosure relates to a circuit for generating a temperature-stabilized reference voltage on a semiconductor chip. Circuits of this type are known in semiconductor circuit engineering as bandgap voltage reference (BVR) circuits.

BACKGROUND

Semiconductor BVR circuits are used to a great extent as voltage references for operating voltages in analog, digital and mixed analog-digital circuits. Conventional BVR circuits operate on the principle of the addition of two partial voltages with opposite temperature responses. While one partial voltage rises proportionately with the absolute temperature (PTAT partial voltage, also referred to as "proportional to absolute temperature"), the other partial voltage falls as the temperature rises (CTAT partial voltage, also referred to as "complementary to absolute temperature"). An output voltage with low sensitivity is obtained as the sum of these two partial voltages.

BVR circuits which are accurate and stable versus temperature, supply voltage and manufacturing variations are desirable. Further, BVR circuits are desired to be inexpensive and capable of allowing some load current connected to the output. Still further, in some applications BVR circuits are desired to provide low output reference voltages.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. Like reference numerals designate corresponding similar parts.

DETAILED DESCRIPTION

Figure 1:
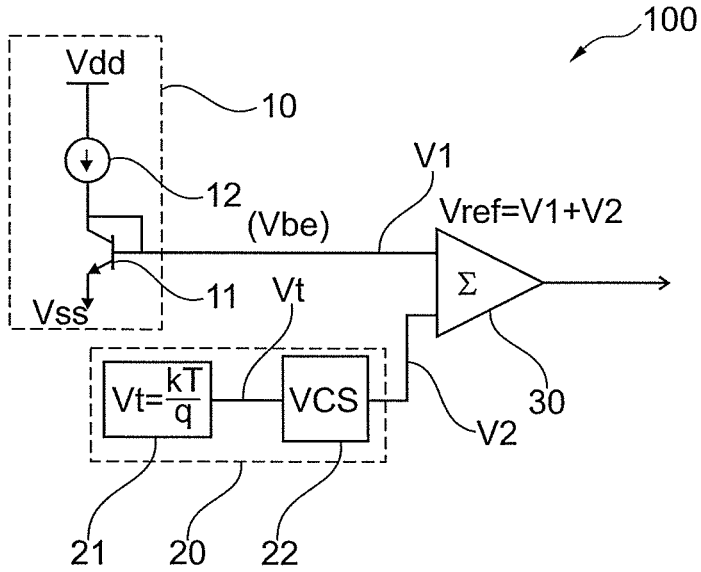
FIG. 1 is a schematic block diagram of an exemplary bandgap voltage reference circuit.

In the following detailed description, reference is made to the accompanying drawings, which form a part thereof, and in which is shown by way of illustration specific embodiments in which the disclosure may be practiced. In this regard, directional terminology, such as "top", "bottom", "left", "right", "upper", "lower", etc., is used with reference to the orientation of the Figure(s) being described. Because components of the embodiments can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

It is to be understood that the features of the various exemplary embodiments described herein may be combined with each other, unless specifically noted otherwise. In this specification, the term "exemplary" is intended to mean an example, rather than to mean preferred.

As employed in this specification, the terms "coupled" and/or "connected" are not meant to mean in general that elements must be directly coupled or connected together. Intervening elements may be provided between the "coupled" or "connected" elements. However, although not restricted to that meaning, the terms "coupled" and/or "connected" may also be understood to optionally disclose an implementation in which the elements are directly coupled or connected together without intervening elements provided between the "coupled" or "connected" elements. The disclosure of a direct coupling or connection may, in particular, be available if it is depicted by way of example in one or more of the exemplary circuit diagrams shown in the Figures.

Devices comprising a bandgap voltage reference (BVR) circuit are described herein. A BVR circuit is a circuit that provides a temperature and supply insensitive output voltage. BVR circuits are used to a great extent as voltage references for operating voltages in analog, digital and mixed analog-digital circuits. In particular they are used in integrated circuits (ICs) and memory devices. By way of example, BVR circuits may, e.g., be used in dynamic random access memories (DRAM), flash memories, power supply generation devices, DC bias voltage devices, current sources, analog-to-digital converters (ADCs), and digital-to-analog converters (DACs).

A BVR circuit, as described herein, may, e.g., provide an IC (Integrated Circuit) reference voltage. The reference voltage is, e.g., accurate and stable versus temperature, supply, and manufacturing variations. Further, the BVR circuit may be configured to work for supply voltages Vdd of, e.g., Vdd<=1.20V. In particular, BVR circuits configured to be operated by a supply voltage Vdd of less than e.g. 1.20V, 1.00V, 0.90V, 0.80V are considered herein.

Further, BVR circuits described herein may be configured to generate reference voltages Vref of, e.g., Vref<=1.20V. In particular, BVR circuits configured to generate reference voltages Vref of less than e.g. 1.20V, 1.00V (so-called sub-1V BVR circuits), 0.90V, 0.80V are considered herein.

In this respect, it is to be noted that the expression "bandgap" as used in the term BVR does not imply that the output reference voltage Vref is near to the bandgap voltage of the semiconductor material, e.g. around 1.25V corresponding to the bandgap voltage of silicon. In contrast, as exemplified above, Vref may be significantly lower than the semiconductor material bandgap voltage.

Further, BVR circuits disclosed herein may be compatible with standard CMOS (Complementary Metal Oxide Semiconductor) processing. By way of example, MOSFETs (Metal-Oxide-Semiconductor Field-Effect Transistors) and NPN bipolar junction transistors (BJT) are available in standard CMOS processes. By way of example, special devices such as, e.g., lateral bipolar junction transistors (lateral BJTs) are not available in a standard CMOS processes. As the BVR circuits described herein may, e.g., be implemented without the use of any lateral BJT or any other devices not available in standard CMOS wafer processing, a standard CMOS process may, e.g., be used to manufacture BVR circuits described herein.

In conventional BVR circuits, an output reference voltage Vref is obtained based on a voltage that is proportional to absolute temperature (PTAT) and a voltage with negative temperature coefficient, which is complementary to absolute temperature (CTAT). As the temperature coefficients of these two voltages are opposite, a composition of the PTAT voltage and the CTAT voltage is insensitive to temperature variations.

Referring to FIG. 1, an exemplary BVR circuit 100 in accordance with the disclosure may comprise a first circuit section 10 configured to generate a CTAT voltage V1, a second circuit section 20 configured to generate a voltage V2, and a combiner 30 configured to generate the reference voltage Vref=V1+V2. In BVR circuit 100, the voltage V2 is generated to have a larger temperature coefficient in relation to the absolute value than the normally used PTAT voltage.

More specifically, the CTAT voltage V1 generated by the first circuit section 10 may be obtained from the voltage across a forward biased p-n junction or the base-emitter voltage Vbe of a diode connected bipolar junction transistor (BJT) 11. Here, Vdd denotes the positive supply voltage, Vss denotes the negative supply voltage, e.g. ground, and reference numeral 12 denotes a current source connected in series with BJT 11 between Vdd and Vss.

The second circuit section 20, which provides the voltage V2, may comprise a thermal voltage generation stage 21 and a voltage conversion stage (VCS) 22. The voltage conversion stage 22 may have an input connected to an output of the thermal voltage generation stage 21. The thermal voltage generation stage 21 may produce a thermal voltage Vt=kT/q, where k is the Boltzmann constant, q is the electron charge and T is the temperature. Thus, the temperature coefficient of the thermal voltage Vt is k/q. Typically, k/q is too small to compensate for the complementary temperature behavior of the CTAT voltage V1.

Thermal voltage Vt may be fed into the voltage conversion stage 22 and converted therein into the voltage V2.

In conventional BVR circuits, the voltage conversion stage 22 is a mere amplification stage, i.e. the thermal voltage Vt is amplified by a factor K to obtain the required PTAT voltage equal to K·Vt. The amplification factor K is adjusted to allow the PTAT voltage K·Vt to compensate the temperature behavior of the CTAT voltage V1. In accordance with the disclosure herein, the voltage conversion stage 22 is configured to generate V2 to have the same temperature coefficient than a (conventional) PTAT voltage (i.e. K·k/q) with, however, significantly smaller absolute values of V2 than K·Vt for a given temperature T. That is, the BVR circuit 100 is configured to generate the voltage V2 to have smaller absolute values than K·Vt for a given temperature T.

CTAT voltage V1 and voltage V2 are combined in combiner 30 to generate the reference voltage Vref. Combiner 30 may, e.g., be an adder. That is, Vref may be generated by combining, in particular adding, V1 and V2.

Figure 2:
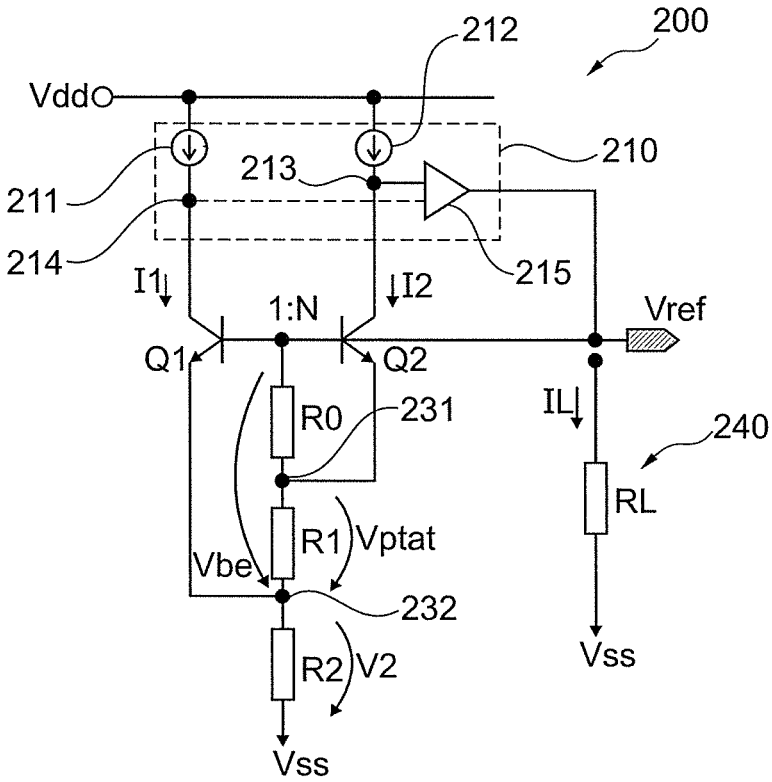
FIG. 2 is a simplified schematic diagram of an exemplary bandgap voltage reference circuit.

Referring to FIG. 2, an exemplary BVR circuit 200 is illustrated which is, e.g., suitable for fabrication with standard CMOS processes. BVR circuit 200 may comprise a differential pair of transistors Q1 and Q2. Q1 and Q2 may each e.g. be NPN bipolar junction transistors (BJT), which are available in all standard CMOS processes (with triple-well option).

A resistor R1 may be connected between the emitter of Q1 and the emitter of Q2. The base of Q1 and the base of Q2 may be interconnected. Further, the base of Q1 and/or the base of Q2 may, e.g., be coupled to the output reference voltage Vref.

The differential pair Q1, Q2 together with resistor R1 may form an asymmetric differential amplifier. That is, the differential pair Q1, Q2 is configured to operate at different current densities with a current density ratio of 1:N. There are various possibilities to implement different current densities in the differential pair Q1 and Q2. According to one possibility, the ratio 1:N of the current densities may be implemented by specifically sizing of the transistors Q1, Q2 to an area ratio corresponding to 1:N. According to another possibility, a current ratio I1:I2 corresponding to 1:N may be forced to flow through equally-sized transistors Q1 and Q2, respectively. It is also possible to combine these two approaches, i.e. to provide for a specific, unequal sizing of transistors Q1 and Q2 and to provide for a current ratio I1:I2 different than 1 to arrive at the desired current density ratio of 1:N.

In the following, the term asymmetric differential pair Q1, Q2 is used to mean that the differential pair Q1, Q2 is operated at a current density ratio of 1:N, wherein N is a number unequal to 1. By way of example, N may be an integer unequal to 1.

An upper part 210 of the circuit diagram of BVR circuit 200 may be implemented in various different ways, and some thereof will be exemplified further below in conjunction with FIGS. 4 to 6. Generally, the upper part 210 may be configured to provide the first current I1 flowing through the first transistor Q1, and the second current I2 flowing through the second transistor Q2. By way of example, the first current I1 may be provided by a first current source 211 and the second current I2 may be provided by a second current source 212. The first current source 211 may be coupled between Vdd and a collector of transistor Q1, and the second current source 212 may be coupled between Vdd and a collector of transistor Q2.

The upper part 210 may further comprise an amplification stage 215. The amplification stage 215 may have an input coupled to at least one of the current branches defined by the first current source 211 and/or the second current source 212.

The amplification stage 215 may, e.g., be a differential amplifier having a differential amplification input. In this case, a first input of the (differential) amplification stage 215 may be coupled to a node 214 in the first current branch defined by the first current source 211, and a second input of the (differential) amplification stage 215 may be coupled to a node 213 in the second current branch defined by the second current source 212.

Further, a feedback circuit comprising the amplification stage 215, Q1 and Q2 configured to control the first current I1 and/or the second current I2 is provided. To that end, an output of the amplification stage 215 may control the asymmetric differential pair Q1, Q2. By way of example, the base of the first transistor Q1 may be coupled to the output of the amplification stage 215, and/or the base of the second transistor Q2 may be coupled to the output of the amplification stage 215.

Thus, the upper part 210 of the BVR circuit may be operative to control the currents I1 and I2 flowing through the differential pair Q1, Q1, respectively. More specifically, the amplification stage 215 may be operative to control the first current I1 provided by the first current source 211 and the second current I2 provided by the second current source 212 to have a defined ratio I1:I2. By controlling the currents I1 and I2, a feedback loop including the upper part 210 and the differential pair Q1, Q2 is implemented. As the currents I1 and I2 may, optionally, be used to create the asymmetry of the differential pair Q1, Q1, the feedback loop may, optionally, also be configured to cause the asymmetry of the differential pair Q1, Q2. Thus, the differential pair Q1, Q2 or the feedback loop or both are configured to cause the current density flowing through the first transistor Q1 to be unequal to the current density flowing through the second transistor Q2.

Further, the output of the amplification stage 215 may, e.g., provide Vref. That way, a low impedance output of the BVR circuit 200 is obtained. As will be described further below in conjunction with FIG. 7, other implementations to provide Vref are feasible.

By way of example, resistors R0, R1 and R2 may be connected in series between the bases of transistors Q1 and Q2 and Vss. The bases of transistors Q1 and Q2 may, e.g., be tied together. As illustrated in FIG. 2, the emitter of the second transistor Q2 may be connected to a node 231 between resistor R0 and resistor R1. The emitter of the first transistor Q1 may be connected to a node 232 between resistor R1 and resistor R2.

As will be explained further below in more detail, the resistor R0 is used to provide a partial current which adds up to the total current flowing through R1, wherein the partial current has a CTAT behavior and is, in this specific example, generated by the feedback loop (upper part 210, Q1, Q2). However, forcing a partial current having a CTAT behavior to flow through resistor R1 may be done by other means than resistor R0, e.g. by another type of current source generating a partial current having a CTAT behavior. In general, a current source configured to generate the partial current having a CTAT behavior flowing through R1 does not have to be controlled by the feedback loop 210, Q1, Q2. Thus, resistor R0 is merely a specific example of a current source which is controlled by the feedback loop 210, Q1, Q2 and which is configured to inject a partial current of CTAT behavior in the current flowing through R1.

Further, FIG. 2 illustrates, by way of example, a load circuitry 240. The load circuitry 240 may correspond to any circuitry such as, e.g., an IC, a memory device, etc. configured to be operated by the reference voltage Vref. The load circuitry 240 is represented in FIG. 2 by load resistor RL. In a closed circuit condition, in which the load circuitry 240 is connected to Vref, a load current IL flows from the reference voltage output of the BVR circuit 200 to Vss.

In the following, the operation of the BVR circuit 200 is described. For a better understanding of the operation of the BVR circuit 200, the resistor R0 (or, more generally, the current source configured to inject a partial current of CTAT behavior into the current flowing through resistor R1) is firstly neglected.

The asymmetric nature of the differential pair Q1, Q2 generates two different base-emitter voltages at the first transistor Q1 and the second transistor Q2. The difference between these base-emitter voltages is the thermal voltage Vptat of an asymmetric differential pair and appears as a voltage drop over resistor R1, i.e. between nodes 231 and 232.

In an equilibrium state, the feedback loop, i.e. the coupling between the bases of the differential pair Q1 and/or Q2 and the output of the amplification stage 215, adjusts the currents I1 and I2 accordingly, so that they follow a strict PTAT behavior:

$$Vptat = Vt \cdot \ln(N) = I2 \cdot R1 \tag{1}$$

with Vt=thermal voltage (Vt=kT/q; Vt~26 mV at 300K), and neglecting base currents.

Because of the series connection of resistor R1 and resistor R2, the resistor R2 acts as a multiplier for Vptat and the generated voltage drop V2 over resistor R2 is also a PTAT voltage.

$$V2 = Vptat \cdot \frac{R2}{R1} \cdot \left(1 + \frac{I1}{I2}\right). \tag{2}$$

In this way, Vref would be the sum of a CTAT voltage component (Vbe) and a PTAT voltage component (V2), and for zero temperature coefficient would result in the standard bandgap of ~1.2V.

However, by adding resistor R0 in parallel to the base and emitter of transistor Q2, an additional current—recited above as a partial current—is included in the current flowing through "current injection" resistor R1. This partial current from the feedback loop 210, Q1, Q2 through resistor R0 has CTAT behavior and adds up with I2 when flowing through resistor R1. As a result, the feedback through amplification stage 215 generates the second current I2 (and, optionally, the first current I1) with a much higher temperature coefficient, in order to overcompensate the CTAT component, and to generate Vptat as described in equation (1). The voltage over resistor R2 coupled to node 232 has therefore also a "stronger" PTAT behavior in relation to its absolute value and can thus be adjusted to smaller values to achieve the required PTAT temperature coefficient for a compensated reference voltage output Vref. That way, a reference voltage Vref in a range between 0.8V and 1.2V may be generated, which is suitable for low-voltage operation.

It is to be noted that various variations of the BVR circuit 200 are feasible. By way of example, transistors Q1 and Q2 may, e.g., each be PNP bipolar junction transistors (BJT).

Figure 3:
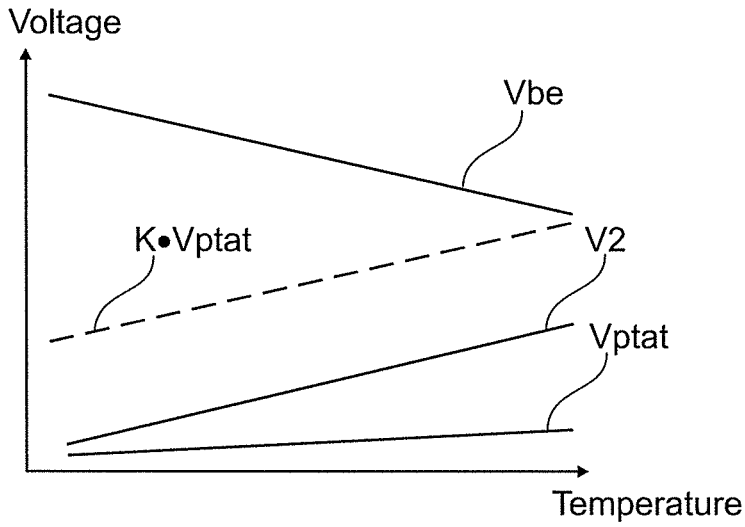
FIG. 3 is a chart illustrating a voltage versus temperature behavior of partial voltages provided in an exemplary bandgap voltage reference circuit.

FIG. 3 illustrates the temperature behavior of the voltages referred to above. In a standard bandgap concept (Vt=Vptat), Vptat is linearly amplified to K·Vptat in order to obtain the opposite temperature coefficient of the CTAT voltage Vbe. In contrast, according to the disclosure herein, the same temperature coefficient may be generated with the voltage V2 having, however, a significant smaller absolute value than K·Vt at a given temperature T.

Returning to FIG. 2, the reference voltage Vref may be generated at the output of the amplification stage 215. Therefore it may exhibit a low output impedance and can deliver any current to the external load circuitry 240. Further, it is to be noted that the reference voltage Vref may stay unchanged for varying base-currents of the transistors Q1 and/or Q2.

For the specific example of I1=I2, the reference voltage Vref is calculated as follows:

$$Vref = Vbe \cdot \left(1 - \frac{R2}{R0}\right) + Vt \cdot \ln(N) \cdot \left(\frac{2R2}{R1} + \frac{R2}{R0}\right). \tag{2}$$

Figure 4:
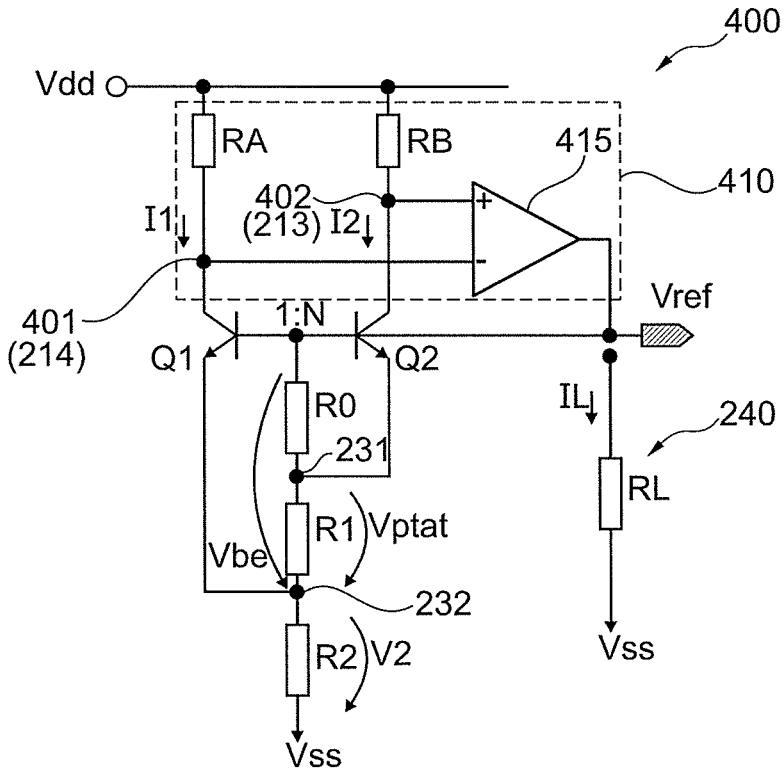
FIG. 4 is a schematic diagram of an exemplary bandgap voltage reference circuit in accordance with the implementation shown in FIG. 2.

FIG. 4 illustrates an exemplary BVR circuit 400. BVR circuit 400 may be a specific implementation of the BVR circuit 200, and reference is made to the previous description in order to avoid reiteration.

In FIG. 4 a specific implementation of the circuitry of the upper part 210 of the BVR circuit 200 is exemplified and denoted by reference numeral 410. The above description to the operation of the upper part 210 also applies to the operation of the upper part 410, and reference is made thereto in order to avoid reiteration.

The upper part 410 illustrated in FIG. 4 may comprise a first resistor RA connected in the first current branch (current I1) and a second resistor RB connected in the second current branch (current I2). That is, the first resistor RA may be connected between Vdd and the collector of transistor Q1, and the second resistor RB may be connected between Vdd and the collector of transistor Q2. The upper part 410 may further comprise a differential amplifier 415 having a negative input connected to, e.g., a node 401 located in the first current branch and a positive input connected to, e.g., a node 402 located in the second current branch. The nodes 401 and 402 may be represented by those terminals of resistors RA and RB, respectively, which are opposite to the terminals connected to Vdd.

The upper part 410 as exemplified in FIG. 4 may be understood to represent the function of a current mirror, using RA and RB as current sources (corresponding to the current sources 211, 212 as shown in FIG. 2) by regulating the remaining circuitry to achieve a defined ratio of I1:I2 by forcing the voltages at node 401 and node 402 to the same value by virtue of the differential amplifier 415 (embodying the amplification stage 215 as shown in FIG. 2).

Figure 5:
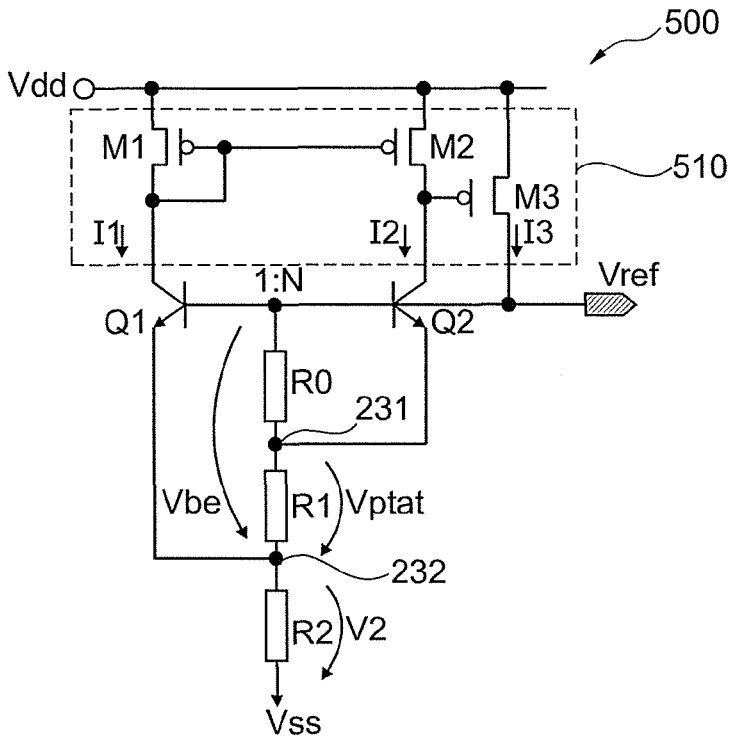
FIG. 5 is a schematic diagram of an exemplary bandgap voltage reference circuit in accordance with the implementation shown in FIG. 2.

FIG. 5 illustrates, by way of example, another possible implementation of an upper part 510 in accordance with the upper part 210 of FIG. 2. Apart from this, BVR circuit 500 illustrated in FIG. 5 may be identical to BVR circuit 200, and reference is made to the corresponding disclosure herein in order to avoid reiteration.

Upper part 510 may comprise a transistor M1 located in the first current branch (current I1) and a transistor M2 located in the second current branch (current I2). Transistors M1 and M2 may, e.g., be MOS transistors (here depicted, by way of example, as PMOS transistors). The gate of MOS transistor M1 may be connected to the drain thereof.

Thus, the resistors RA and RB of BVR circuit 400 may be considered in BVR circuit 500 to be replaced by "active loads". Together with bipolar transistors Q1 and Q2, which may, e.g., be NPN transistors, transistors M1 and M2 form a first amplification stage having an output at the collector of transistor Q2.

Further, the upper part 510 may comprise a third transistor M3. Third transistor M3 may be a MOS transistor, by way of example a PMOS transistor as depicted herein, and may represent a second amplification stage of the amplification stage 215 of upper part 210 as illustrated in FIG. 2. Third transistor M3 may be connected between Vdd and the bases of transistors Q1 and/or Q2. It may deliver the required "extra" current to the resistor R0. Further, third transistor M3 may deliver the current to the differential input pair Q1, Q2 (i.e. the base currents of transistors Q1 and Q2) in order to close the feedback loop. Further, the third transistor M3 may deliver the current required by a load circuitry 240 connected to the reference voltage output Vref.

Using three PMOS transistors M1, M2, M3 in this combination may, e.g., be advantageous because, as a result, the collector voltages of the transistors Q1 and Q2 of the differential pair will be almost equal, especially for varying supply voltages and manufacturing process variations. This stabilizes the current ratio I1:I2 and improves overall accuracy of the BVR circuit 500. However, transistors M1, M2, M3 of the upper part 510 may, e.g., also be NMOS transistors.

The second amplification stage represented by MOS transistor M3 may be replaced by an second amplification stage having more than one transistor. This may in particular be suitable if high currents I3 are desired in order to operate loads RL with very high current demands.

Figure 6:
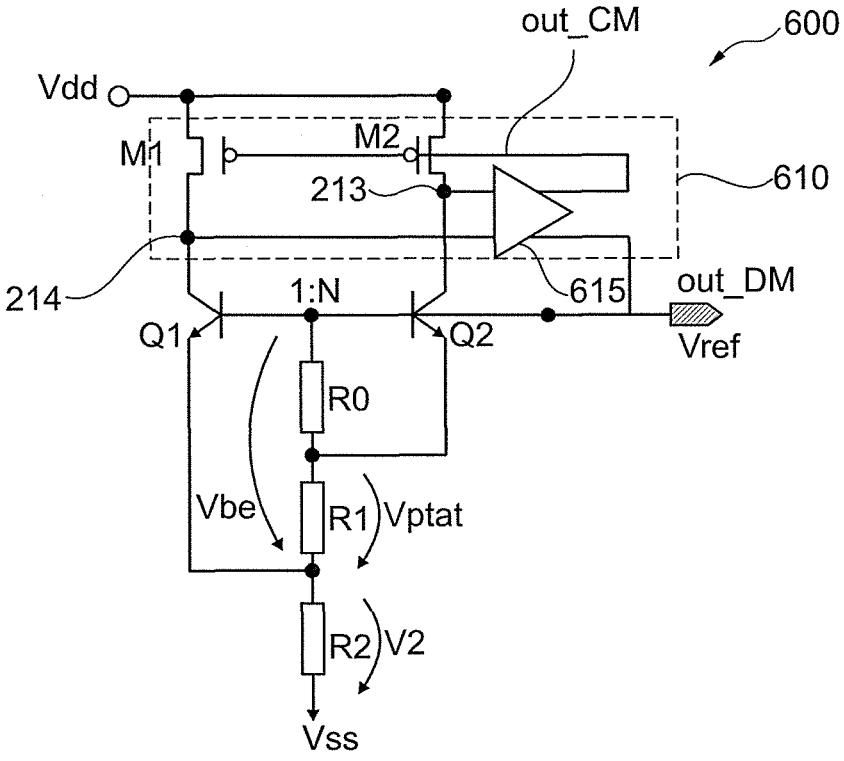
FIG. 6 is a schematic diagram of an exemplary bandgap voltage reference circuit in accordance with the implementation shown in FIG. 2.

As shown in FIG. 6, the upper part 210 of a BVR circuit 600 may, e.g., be implemented in other ways, e.g. by a "folded cascode" structure to enable operation with very low levels of Vdd, and hence, low values of Vref. A generalized description of such alternatives is illustrated by upper part 610 shown in FIG. 6. The upper part 610 may comprise a first MOS transistor M1 and a second MOS transistor M2. In view of MOS transistors M1 and M2, reference is made to the description of FIG. 5 to avoid reiteration. However, as a variation to the circuitry of upper part 510, the gate of MOS transistor M1 may not be connected to the drain thereof.

The structure illustrated by way of example by upper part 610 may have a differential mode output ("out_DM") which may amplify the differential input signals received at differential amplifier 615. The differential mode output out_DM may be coupled to the bases of differential pair Q1, Q2. Generally speaking, the differential mode output out_DM (which corresponds to the output of amplifier stage 215 of upper part 200) regulates the main feedback loop, provides the "extra" current to R0 and may, e.g., provide the current for operating the load RL.

Further, amplifier 615 may provide a common-mode output ("out_CM"). The common-mode output out_CM may control the common-mode level of the first amplification stage (represented, e.g., by transistors M1 and M2) within a second feedback loop. Thus, the differential mode output out_DM and out_CM of the amplifier stage 615 may control two feedback loops, one for the extra current through R0 and one for the I1 and I2 generation.

It is to be noted that many other implementations of the upper part 210 of the BVR circuit 200 are feasible and that the examples disclosed herein, e.g. the resistor implementation of upper part 410, the transistor implementation of upper part 510 and the dual feedback loop implementation of upper part 610, are mere illustrative examples of the disclosure provided herein.

Figure 7:
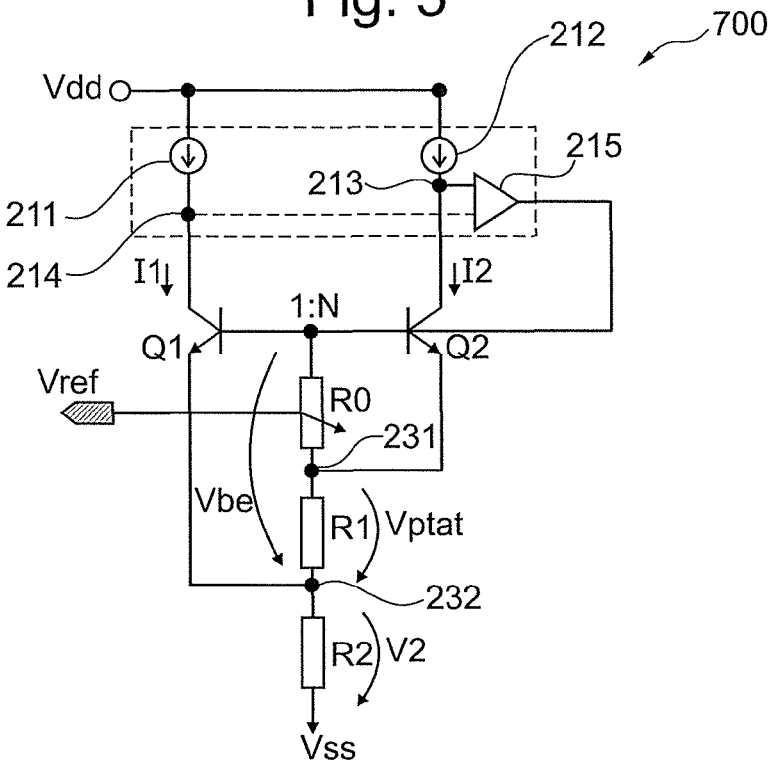
FIG. 7 is a simplified schematic diagram of an exemplary bandgap voltage reference circuit.

FIG. 7 illustrates further variations of implementations of BVR circuits disclosed herein. The BVR circuit 700 illustrated in FIG. 7 may be identical to the BVR circuit 200 of FIG. 2, except that the reference voltage Vref is tapped at a node inside the resistor string comprising, e.g., resistor R0, resistor R1, resistor R2 rather than at an output of an amplification stage 215. By way of example, the node where Vref is tapped may be located within resistor R0. In this case, resistor R0 may be implemented by two resistors connected in series and having a total resistance R0.

When tapping the reference voltage Vref within R0, i.e. between the base of transistor Q1 and/or transistor Q2 and node 231, a temperature compensated reference voltage output Vref with levels smaller than 0.9V, 0.8V, 0.7V, etc. is possible.

In FIG. 7 tapping Vref at a node inside the resistor string is illustrated for BVR circuit 700 which uses the upper part 210 of FIG. 2. However, it is to be noted that tapping the reference voltage Vref inside the resistor string comprising, e.g., R0, R1, and R2 may be applied to any of the implementations of BVR circuits 400, 500, 600 as described herein. That way, by tapping within the resistor string, the voltage level of Vref may be reduced. However, as low output impedances as obtainable when tapping Vref at an output of an amplification stage 215 such as, e.g., the outputs of amplifiers 415, 515, 615, may not be possible.

All implementations disclosed herein may provide high accuracy of Vref over manufacturing variations. Prior art solutions usually may achieve lower precision due to the offset of a MOSFET differential pair. Further, prior art solutions generate a reference voltage equal to or less then 1.2V in open loop control (i.e. not within a feedback loop operation) and are typically sensitive to mismatch of current mirrors. BVR circuits as illustrated herein do not experience such matching requirements, and a bipolar junction transistor differential pair Q1, Q2, as, e.g., used herein, may have a much lower offset. Further, there is no sensitivity towards the bipolar-gain (beta).

It is to be noted that in the implementations disclosed herein the output reference voltage Vref can be adjusted to levels equal to or less than 1.2V, 1.1V, 1.0V, 0.9V, 0.8V, or even less. This allows low supply voltages suitable for modern fabrication technologies.

Another aspect to be noted is that the reference voltage Vref may be generated inside a feedback loop.

Further, low output impedances may be obtained. The reference voltage Vref is not degraded by load currents, since Vref may be tapped inside the feedback loop.

Low output noise may be achieved. Again, the feedback loop may effectively suppress the circuit noise appearing at the reference voltage output Vref.

Low area and power requirements may be met. Due to the effective usage of few internal current branches, power requirements are lowered to a minimum. By way of example, as exemplified in the figures, only three or even only two internal current branches are used. Further, in specific implementations, only three transistors are needed, namely the bipolar junction transistor Q1, the bipolar junction transistor Q2 and one transistor for the amplification stage 215. Thus, mismatch and errors are reduced and little area is needed.

In other words, the simplicity of the BVR circuits 100, 200, 400, 500, 600, 700 disclosed herein may result in fewer sources of error, small area demand and low power consumption.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A circuit for generating a temperature-stabilized reference voltage on a semiconductor chip, comprising:

a differential pair comprising a first bipolar junction transistor and a second bipolar junction transistor;

a feedback circuit comprising an amplification stage and configured to control a first current flowing through the first bipolar junction transistor and a second current flowing through the second bipolar junction transistor;

a first resistor connected between an emitter of the first bipolar junction transistor and an emitter of the second bipolar junction transistor, thereby generating a proportional to absolute temperature (PTAT) voltage across the first resistor; and a current source forcing a partial current having a complementary to absolute temperature (CTAT) behavior through the first resistor, wherein the current source comprises a current injection resistor connected between an output of the amplification stage and the first resistor.

2. The circuit of claim 1, wherein the differential pair or the feedback circuit or both are configured to cause a current density flowing through the first bipolar junction transistor to be unequal to a current density flowing through the second bipolar junction transistor.

3. The circuit of claim 1, wherein the amplification stage comprises an output coupled to the base of one or both of the first bipolar junction transistor and the second bipolar junction transistor.

4. The circuit of claim 1, wherein the feedback circuit further comprises a first current source for providing the first current flowing through the first bipolar junction transistor and a second current source for providing the second current flowing through the second bipolar junction transistor.

5. The circuit of claim 4, wherein the first current source comprises a first current source resistor connected between a supply voltage and a collector of the first bipolar junction transistor and the second current source comprises a second current source resistor connected between the supply voltage and a collector of the second bipolar junction transistor.

6. The circuit of claim 4, wherein the amplification stage comprises a differential amplifier having a first input coupled to an output of the first current source and a second input coupled to an output of the second current source.

7. The circuit of claim 4, wherein the first current source comprises a first MOS transistor connected between a supply voltage and a collector of the first bipolar junction transistor and the second current source comprises a second MOS transistor connected between the supply voltage and a collector of the second bipolar junction transistor.

8. The circuit of claim 1, wherein the amplification stage comprises a differential amplifier having a differential mode output and a common mode output.

9. The circuit of claim 1, wherein the current source comprises a current injection resistor connected between a base of the first bipolar junction transistor or the base of the second bipolar junction transistor or the bases of both the first and second bipolar junction transistors and the first resistor.

10. The circuit of claim 1, wherein a reference voltage output of the circuit is connected to an output of the amplification stage.

11. The circuit of claim 1, wherein a reference voltage output of the circuit is tapped at a resistor string comprising the first resistor.

12. The circuit of claim 1, wherein the amplification stage is configured to provide a current for controlling the differential pair and the partial current for the current source.

13. A circuit for generating a temperature-stabilized reference voltage on a semiconductor chip, comprising:

a differential pair comprising a first bipolar junction transistor and a second bipolar junction transistor;

a feedback circuit comprising an amplification stage and configured to control a first current flowing through the first bipolar junction transistor and a second current flowing through the second bipolar junction transistor;

a current injection resistor connected between an output of the amplification stage and a first node, wherein the first node is connected to an emitter of the second bipolar junction transistor; and a first resistor connected between the first node and a second node, wherein the emitter of the first bipolar junction transistor is connected to the second node.

14. The circuit of claim 13, wherein the output of the amplification stage is connected to a base of at least one of the first bipolar junction transistor and the second bipolar junction transistor.

15. The circuit of claim 13, further comprising a second resistor connected between the second node and negative supply voltage.

16. The circuit of claim 13, wherein the reference voltage is supplied at an output of the amplification stage.

17. The circuit of claim 13, wherein the reference voltage is tapped at a resistor string comprising the current injection resistor and the first resistor.

18. A circuit for generating a temperature-stabilized reference voltage on a semiconductor chip, comprising:

a first circuit section configured to generate a complementary to absolute temperature (CTAT) voltage, wherein the CTAT voltage drops over a current injection resistor and a first resistor;

a second circuit section configured to generate a voltage which has the same temperature coefficient than a proportional to absolute temperature (PTAT) voltage adjusted to compensate the CTAT voltage temperature behavior, the voltage having smaller absolute values than the PTAT voltage for a given temperature, wherein the voltage drops over a second resistor; and wherein the current injection resistor, the first resistor and the second resistor are connected in series.

19. A circuit for generating a temperature-stabilized reference voltage on a semiconductor chip, comprising:

a differential pair comprising a first bipolar junction transistor and a second bipolar junction transistor;

a feedback circuit comprising an amplification stage and configured to control a first current flowing through the first bipolar junction transistor and a second current flowing through the second bipolar junction transistor;

a first resistor connected between an emitter of the first bipolar junction transistor and an emitter of the second bipolar junction transistor, thereby generating a proportional to absolute temperature (PTAT) voltage across the first resistor; and a current source forcing a partial current having a complementary to absolute temperature (CTAT) behavior through the first resistor, wherein the feedback circuit further comprises a first current source for providing the first current flowing through the first bipolar junction transistor and a second current source for providing the second current flowing through the second bipolar junction transistor, and wherein the first current source comprises a first current source resistor connected between a supply voltage and a collector of the first bipolar junction transistor and the second current source comprises a second current source resistor connected between the supply voltage and a collector of the second bipolar junction transistor.

20. A circuit for generating a temperature-stabilized reference voltage on a semiconductor chip, comprising:

a differential pair comprising a first bipolar junction transistor and a second bipolar junction transistor;

a feedback circuit comprising an amplification stage and configured to control a first current flowing through the first bipolar junction transistor and a second current flowing through the second bipolar junction transistor;

a first resistor connected between an emitter of the first bipolar junction transistor and an emitter of the second bipolar junction transistor, thereby generating a proportional to absolute temperature (PTAT) voltage across the first resistor; and a current source forcing a partial current having a complementary to absolute temperature (CTAT) behavior through the first resistor, wherein the amplification stage comprises a differential amplifier having a differential mode output and a common mode output.

21. A circuit for generating a temperature-stabilized reference voltage on a semiconductor chip, comprising:

a differential pair comprising a first bipolar junction transistor and a second bipolar junction transistor;

a feedback circuit comprising an amplification stage and configured to control a first current flowing through the first bipolar junction transistor and a second current flowing through the second bipolar junction transistor;

a first resistor connected between an emitter of the first bipolar junction transistor and an emitter of the second bipolar junction transistor, thereby generating a proportional to absolute temperature (PTAT) voltage across the first resistor; and a current source forcing a partial current having a complementary to absolute temperature (CTAT) behavior through the first resistor, wherein the current source comprises a current injection resistor connected between a base of the first bipolar junction transistor or the base of the second bipolar junction transistor or the bases of both the first and second bipolar junction transistors and the first resistor.

* * * * *